US010920493B2

(12) United States Patent
Huber et al.

(10) Patent No.: US 10,920,493 B2
(45) Date of Patent: Feb. 16, 2021

(54) METHOD OF FORMING STATORS FOR DOWNHOLE MOTORS

(71) Applicants: Witali Huber, Laatzen (DE); Gunnar Michaelis, Hambuehren (DE); Carsten Hohl, Sehnde (DE); Erik Bartscherer, Hannover (DE); Harald Grimmer, Lachendorf (DE); Christian Fulda, Sehnde (DE); Dorothea Marion Fischer, Hannover (DE); Thorsten Regener, Wienhausen (DE)

(72) Inventors: Witali Huber, Laatzen (DE); Gunnar Michaelis, Hambuehren (DE); Carsten Hohl, Sehnde (DE); Erik Bartscherer, Hannover (DE); Harald Grimmer, Lachendorf (DE); Christian Fulda, Sehnde (DE); Dorothea Marion Fischer, Hannover (DE); Thorsten Regener, Wienhausen (DE)

(73) Assignee: BAKER HUGHES, A GE COMPANY, LLC, Houston, TX (US)

( * ) Notice: Subject to any disclaimer, the term of this patent is extended or adjusted under 35 U.S.C. 154(b) by 479 days.

(21) Appl. No.: 15/437,612

(22) Filed: Feb. 21, 2017

(65) Prior Publication Data

US 2018/0238114 A1 Aug. 23, 2018

(51) Int. Cl.

| | |
|---|---|
| ***F04C 2/107*** | (2006.01) |
| ***E21B 4/02*** | (2006.01) |
| ***B21C 37/20*** | (2006.01) |

(52) U.S. Cl.

CPC ..... *E21B 4/02* (2013.01); *B21C 37/207* (2013.01); *F04C 2/1075* (2013.01); *F04C 2230/20* (2013.01); *F04C 2230/26* (2013.01); *Y10T 29/49242* (2015.01)

(58) Field of Classification Search

CPC ..... E21B 4/02; F04C 2/1075; F04C 2230/26; F04C 2230/20; B21C 37/207

See application file for complete search history.

(56) References Cited

U.S. PATENT DOCUMENTS

| | | | | |
|---|---|---|---|---|
| 6,543,132 | B1 | 4/2003 | Krueger et al. | |
| 6,881,045 | B2 | 4/2005 | Zitka et al. | |
| 7,517,202 | B2 | 4/2009 | Delpassand | |
| 7,950,914 | B2 * | 5/2011 | Hooper | F04C 2/1075 418/152 |
| 8,197,241 | B2 * | 6/2012 | Robisson | F04C 2/1075 418/152 |
| 8,636,485 | B2 * | 1/2014 | Steele | C25D 1/02 205/143 |
| 2001/0005486 | A1 | 6/2001 | Wood | |

FOREIGN PATENT DOCUMENTS

| | | | |
|---|---|---|---|
| KR | 1020140081106 | A | 7/2014 |

OTHER PUBLICATIONS

International Search Report and Written Opinion for International Application No. PCT/US2018/018292; International Filing Date Feb. 15, 2018; Report dated May 25, 2018 (pp. 1-9).

* cited by examiner

*Primary Examiner* — Ryan J. Walters
(74) *Attorney, Agent, or Firm* — Cantor Colburn LLP

(57) ABSTRACT

A method of making a stator includes positioning an inner tubular member having an inner surface within an outer tubular member, installing a rigid mandrel within the inner tubular member, and applying a compressive force to at least one of the inner tubular member and the outer tubular member.

15 Claims, 6 Drawing Sheets

METHOD OF FORMING STATORS FOR DOWNHOLE MOTORS

BACKGROUND

Downhole operations often include a downhole string that extends from an uphole system into a formation. The uphole system may include a platform, pumps, and other systems that support resource exploration, development, and extraction. During resource exploration operations, a drill bit is guided through the formation to form a well bore. The drill bit may be driven directly from the platform or both directly and indirectly through a flow of downhole fluid, which may take the form of drilling mud passing through a motor.

A motor, such as a downhole motor, includes a stator housing having a plurality of lobes and a rotor having another plurality of lobes. The stator is rotated by the downhole string and the rotor by the flow of fluid. The number of lobes on the rotor is one fewer than the number of lobes on the stator. In this manner, the flow of fluid drives the rotor eccentrically while the motor drives the drill bit concentrically. The stator housing may be made by installing a mandrel having a selected outer profile within a tubular member. Force application members are urged against the tubular member with a selected pressure. Internal surfaces of the tubular member take on the selected outer profile. Stator housings may also be formed by pouring molten metal over a mandrel having a selected outer profile.

SUMMARY

A method of making a stator includes positioning an inner tubular member having an inner surface within an outer tubular member, installing a rigid mandrel within the inner tubular member, and applying a compressive force to at least one of the inner tubular member and the outer tubular member.

A Moineau system configured for use in a downhole environment includes an inner tubular member comprising a first metallic material having an outer surface and a helically lobed inner surface integrally formed with the inner tubular member, and an outer tubular member comprising a second metallic material that is different from the first metallic material. The inner tubular member is connected to the outer tubular member by a form fit. The inner tubular member and the outer tubular member form a stator of the Moineau system.

BRIEF DESCRIPTION OF THE DRAWINGS

Referring now to the drawings wherein like elements are numbered alike in the several Figures.

DETAILED DESCRIPTION

Figure 1A:
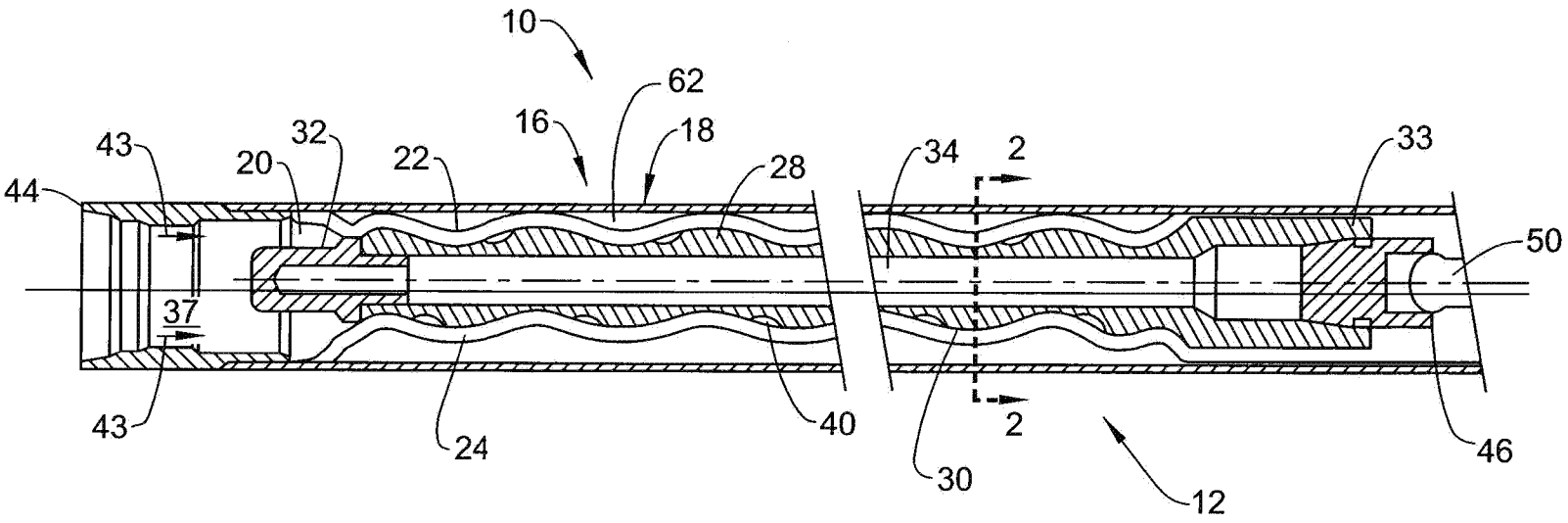
FIG. 1A depicts a cross-sectional view of a power section of a downhole motor including a metal housing, formed in accordance with an exemplary embodiment.
Figure 1B:
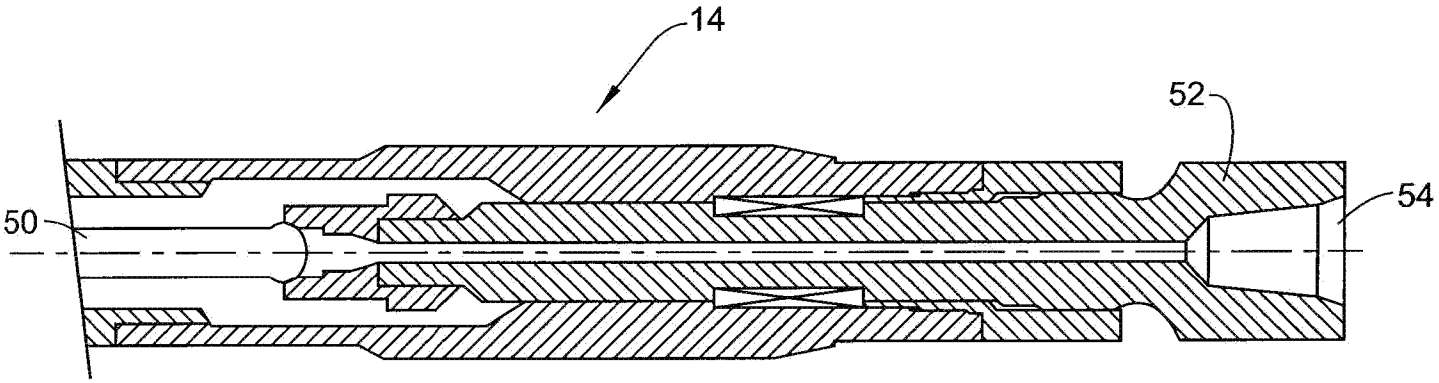
FIG. 1B depicts a cross-sectional view of a bearing assembly the downhole motor of FIG. 1A, formed in accordance with an exemplary embodiment.

A downhole motor, in accordance with an exemplary embodiment, is illustrated generally at 10 in FIGS. 1A and 1B. Downhole motor 10 may take the form of a positive displacement motor, following the Moineau Principle, having a power section 12 (FIG. 1A) operatively coupled to a bearing assembly 14 (FIG. 1B). That is, downhole motor 10 may take the form of a Moineau system configured for use in a downhole environment. Power section 12 includes an elongated composite metal housing 16 that defines a stator 18. The term "composite" should be understood to describe that stator 18 may be formed with multiple layers of material as will be detailed below. Stator 18 includes an interior 20 having a selected inner contour in the form of a helically lobed inner surface 22 that may be defined by an elastomeric layer 24 or by a pre-contoured metal housing. It is to be understood that in the case of a pre-contoured metal housing, helically lobed inner surface 22 may be covered by an elastomeric material, a non-elastomeric material, referred to as a lined stator, or remain uncovered depending upon operating conditions of downhole motor 10.

Downhole motor 10 also includes a rotor 28 arranged in interior 20. Rotor 28 includes a helically lobed outer surface 30 that engages with helically lobed inner surface 22 of stator 18. Helically lobed outer surface 30 includes one less lobe than helically lobed inner surface 22. Rotor 28 includes a first end portion 32, a second end portion 33, and an intermediate portion 34.

In operation, rotor 28 with helically lobed outer surface 30 rotates within stator 18 with helically lobed inner surface 22 to form a plurality of axial fluid chambers or cavities 40 which may be filled with pressurized drilling fluid 37 flowing through interior 20 in a direction 43 from an uphole end 44 toward a downhole end 46 of stator 18. Bearing assembly 14 illustrated in FIG. 1B includes a flexible shaft 50 coupled to a rotatable drive shaft 52 which carries a bit box 54. It is to be understood that additional components (not shown) may be arranged between power section 12 and bearing assembly 14. Bit box 54 may operatively connect to a drill bit (not shown).

Figure 2:
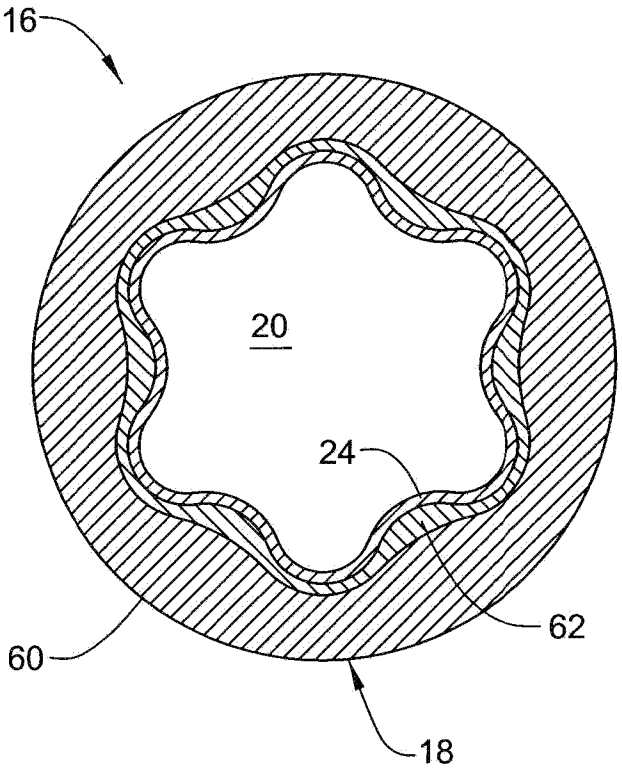
FIG. 2 depicts an axial end view of the stator, in accordance with an aspect of an exemplary embodiment.

In accordance with an exemplary aspect illustrated in FIG. 2, composite metal housing 16 which defines stator 18 includes an outer tubular member 60 formed from a first material (not separately labeled) operatively connected with an inner tubular member 62 formed from a second material (also not separately labeled) that may be distinct from the first material. The term "composite" should be understood to describe that stator 18 may be formed from multiple layers of material. Inner tubular member 62 may be connected to outer tubular member 60 through various processes as will be discussed more fully below. In accordance with an aspect of an exemplary embodiment, inner tubular member 62 may extend an entire longitudinal length of outer tubular member 60. However, it is to be understood that inner tubular member 62 may extend over only a portion of outer tubular member 60. Inner tubular member 62 is shown to include the helically lobed inner surface 22. It should be understood however that helically lobed inner surface 22 may extend into outer tubular member 60.

In accordance with an aspect of an exemplary embodiment, the first material forming outer tubular member 60 includes selected material properties such as strength properties, chemical resistance, corrosion resistance, and/or brittleness, selected to support drilling loads and conditions associated with downhole environments.

In accordance with another aspect of an exemplary embodiment, the second material forming inner tubular member 62 may be selected for other desirable material properties. For example, the second material may be selected to include particular surface properties with respect to mechanical, material and chemical properties, e.g. friction, roughness, hardness, and/or brittleness, heat conductivity, ductility, electrical conductivity, wear resistance and chemical resistance or chemical reactivity. For example, the second material may include a low coefficient of friction. The term "low coefficient of friction" should be understood to mean a material that allows rotor 28 to rotate within stator 18 with limited wear. The use of a low coefficient of friction material may preclude a need for an inner layer in composite metal housing 16.

In another example, the second material may be selected for improved bonding properties with an elastomeric material if used for as an inner layer, a non-elastomeric material if used for an inner layer, or another material having other desirable properties. Examples of desirable materials for inner tubular member 62 may include Copper and copper alloys, Molybdenum and Molybdenum alloys, Nickel and Nickel alloys, steel with various properties (corrosion resistive, hardenable, temperable), duplex steel, materials that are suitable for chemical and/or electro-chemical etching to create a specific surface roughness. In another example, the second material may be softer and more flowable in order to easier form lobes with high accuracy.

In accordance with an aspect of an exemplary embodiment, outer tubular member 60 and inner tubular member 62 may possess similar radial thicknesses. In accordance with another aspect of an exemplary embodiment, outer tubular member 60 and inner tubular member 62 may possess different radial thicknesses. In accordance with another aspect of an exemplary embodiment, outer tubular member 60 may be formed with a radial thickness that is greater than a radial thickness of inner tubular member 62. Conversely, inner tubular member 62 may be formed with a radial thickness that is greater than a radial thickness of outer tubular member 60.

In accordance with another aspect of an exemplary embodiment, various methods may be used to position an inner layer (not shown) also referred to as a lining, or to finish inner surface 22 of inner tubular member 62 such as, for example, physical vapor deposition (PVD), chemical vapor deposition (CVD), injection molding, a plasma spray process, spray coating, chemical deposition, nitriding, carburizing, plasma polymer coating, nitro-carburizing, boriding/boronizing, thermo-set process, baking process, aging. Examples of desirable materials for inner layers may include elastomeric material, thermo-plastic material, metallic material, ceramic material, chrome, graphite, diamond-like carbon (DLC) and alternative suitable materials.

Figure 3:
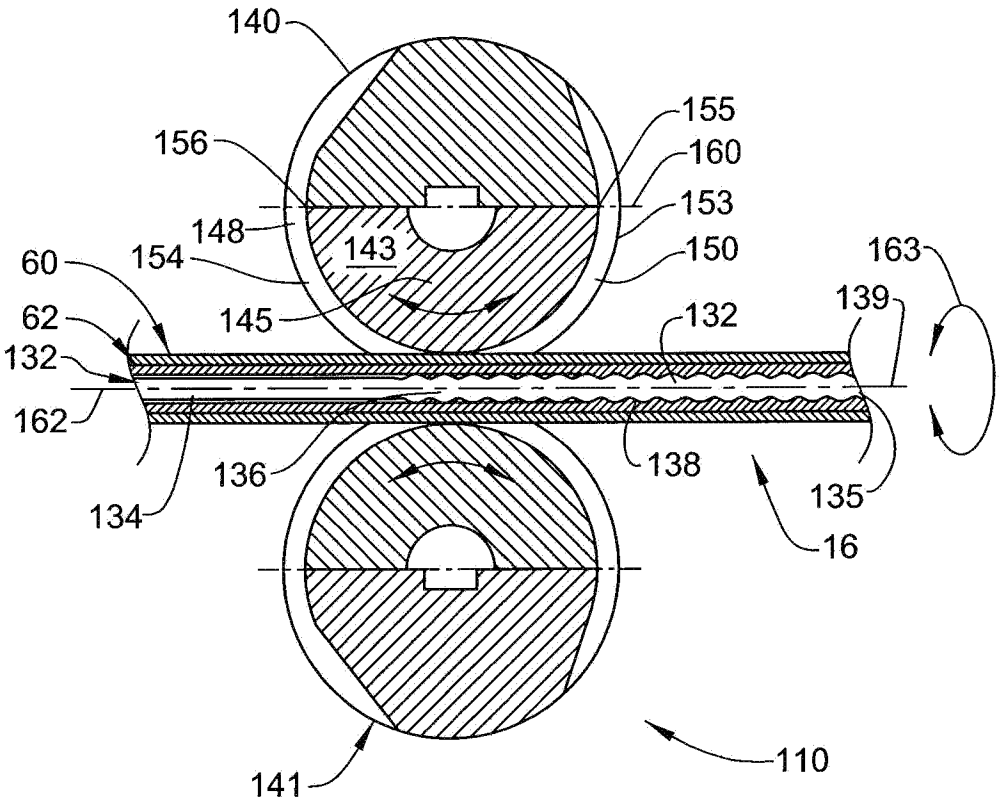
FIG. 3 depicts an elevational view of a rotary system for making the composite metal housing, in accordance with an exemplary embodiment.

Reference will now follow to FIGS. 3-6 in describing various processes for forming composite metal housing 16. FIG. 3 depicts a short stroke rolling process 110. Outer tubular member 60 is positioned about inner tubular member 62. A rigid mandrel 132 may be arranged in interior 20 of inner tubular member 62. In accordance with an aspect of an exemplary embodiment, rigid mandrel 132 may take the form of a contour forming member. Rigid mandrel 132 includes a first end 134, a second end 135, and an intermediate portion 136. Intermediate portion 136 includes a contoured outer surface 138 defining a selected contour that corresponds to helically lobed inner surface 22. The particular shape, form, and/or overall geometry of contoured outer surface 138 may vary depending upon a desired shape, form, and/or geometry of helically lobed inner surface 22. Rigid mandrel 132 defines an axis of rotation 139 for composite metal housing 16.

Inner and outer tubular members 62 and 60 are positioned between a first force application member, depicted as a first roller 140 and a second forced application member depicted as a second roller 141. As each roller 140, 141 is substantially similarly formed, a detailed description will follow with respect to roller 140 with an understanding that roller 141 may include a similar structure. Roller 140 includes a roller die 143 that strokes or reciprocates over outer tubular member 60 in a direction shown by arrow 145. Rollers 140 and 141 urge outer tubular member 60 radially inwardly toward inner tubular member 62. Both outer and inner tubular members 60 and 62 are urged radially inwardly toward rigid mandrel 132 applying a compressive force. By way of non-limiting embodiment rigid mandrel 132 may be tapered from first end 134 to second end 135 with the second end having an outer dimension (not separately labeled) that is less than an outer dimension (also not separately labeled) of first end 134. The taper facilitates easy removal of the rigid mandrel 132 from composite metal housing 16.

Roller 140 includes a caliper section 148 that defines a travel depth of roller die 143 toward outer tubular member 60 and inner tubular member 62. A clearance 150 between roller die 143 and an outer surface 153 or roller die 143 increases along a stroke path 154 defined between a first end section 155 and a second end section 156. In operation, rollers 140 and 141 urge against outer tubular member 60 and reciprocate along stroke path 154 along an axis of movement 160. Roller die 143 travels to greater depths along stroke path 154 applying a compressive force. At the same time, composite metal housing 16 rotates about an axis 162 as shown by arrow 163. As the process continues, inner tubular member 62 takes on a shape corresponding to contoured outer surface 138 of rigid mandrel 132 forming helically lobed inner surface 22. In addition to forming helically lobed inner surface 22, compressive forces applied by rollers 140 and 141 compress outer tubular member 60 onto inner tubular member 62. In another embodiment rigid mandrel 132 may not have a contoured outer surface and may be used only to compress outer tubular member 60 and inner tubular member 62 without forming an inner contoured surface.

In accordance with another aspect of an exemplary embodiment, outer tubular member 60 and/or inner tubular member 62 may comprises multiple material layers that be connected through an application of compressional forces to form composite metal housing 16 of stator 18. Alternatively, in lieu of compressive forces, other connecting methods such as adhesion, forging, cold welding, hot welding, chemical connection, a mechanical connection like a form fit, may be employed to join outer tubular member 60 and inner tubular member 62. The term "form fit" should be understood to describe an interlocking of at least two connecting partners. As a result, the connecting partners cannot detach themselves without or during intermittent force transmission. Thus, in the case of a form-fit or "form locking connection" of one connecting partner, the other connecting partner is in the way. Further, when applying compressive forces, heat may be applied to further enhance connecting characteristics (cold rolled) (hot rolled). Cold may be temperatures up to around 100 Centigrade, intermediate temperatures may be from around 100 Centigrade to 600 Centigrade, hot temperatures may be from 900 Centigrade and above.

Figure 4:
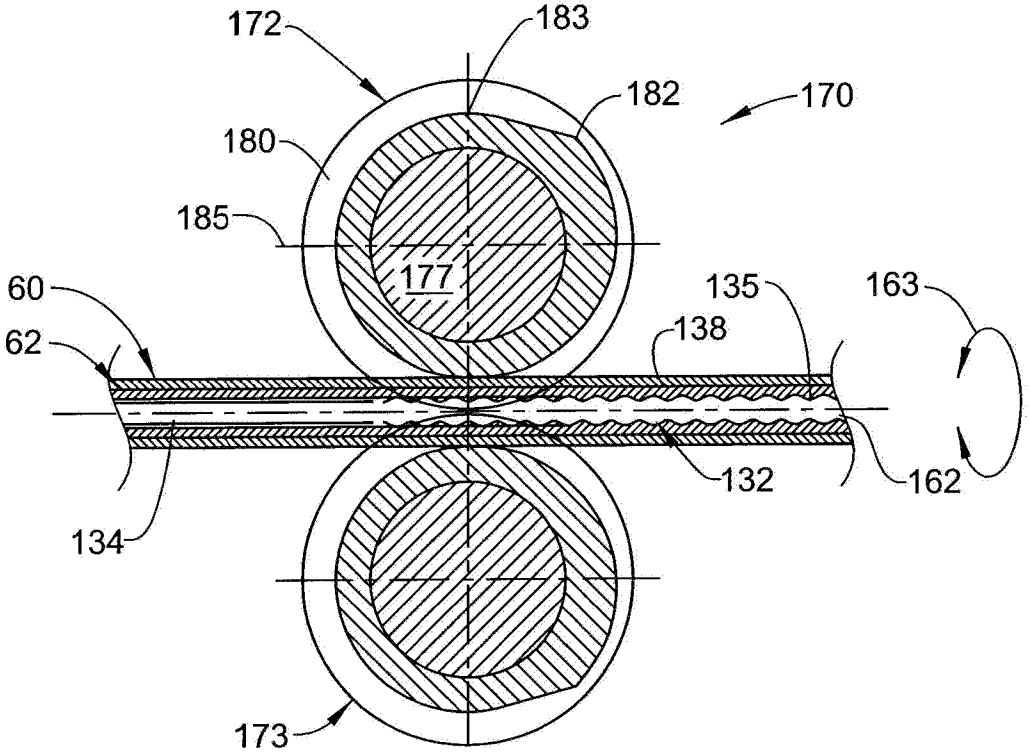
FIG. 4 depicts an elevational view of a rotary system for making the composite metal housing, in accordance with another aspect of an exemplary embodiment.

Reference will now follow to FIG. 4, wherein like reference numbers represent corresponding parts in the respective views in describing a long stroke rolling process 170 employing a first force application member shown as a first roller 172 and a second force application member shown as a second roller 173. As each roller 172, 173 is substantially similarly formed, a detailed description will follow with respect to roller 172 with an understanding that roller 173 may include similar structure. Roller 172 includes a roller die 177 having a stroke path 180 that is longer than stroke path 154 (FIG. 3). Stroke path 180 extends between a first end 182 and a second end 183.

In operation, two rollers, e.g., rollers 172 and 173 urge against outer tubular member 60 applying a compressive force and reciprocate along stroke path 180 along an axis of movement 185. Roller 177 travels to greater depths along stroke path 180. At the same time, composite metal housing 16 (FIG. 2) rotates about axis 162 as shown by arrow 163 in FIG. 4. As the process continues, inner tubular member 62 takes on a shape corresponding to contoured outer surface 138 of rigid mandrel 132 forming helically lobed inner surface 22 (FIG. 1A). In addition to forming helically lobed inner surface 22, compressive forces applied by rollers 172 and 173 compress outer tubular member 60 onto inner tubular member 62.

Figure 5:
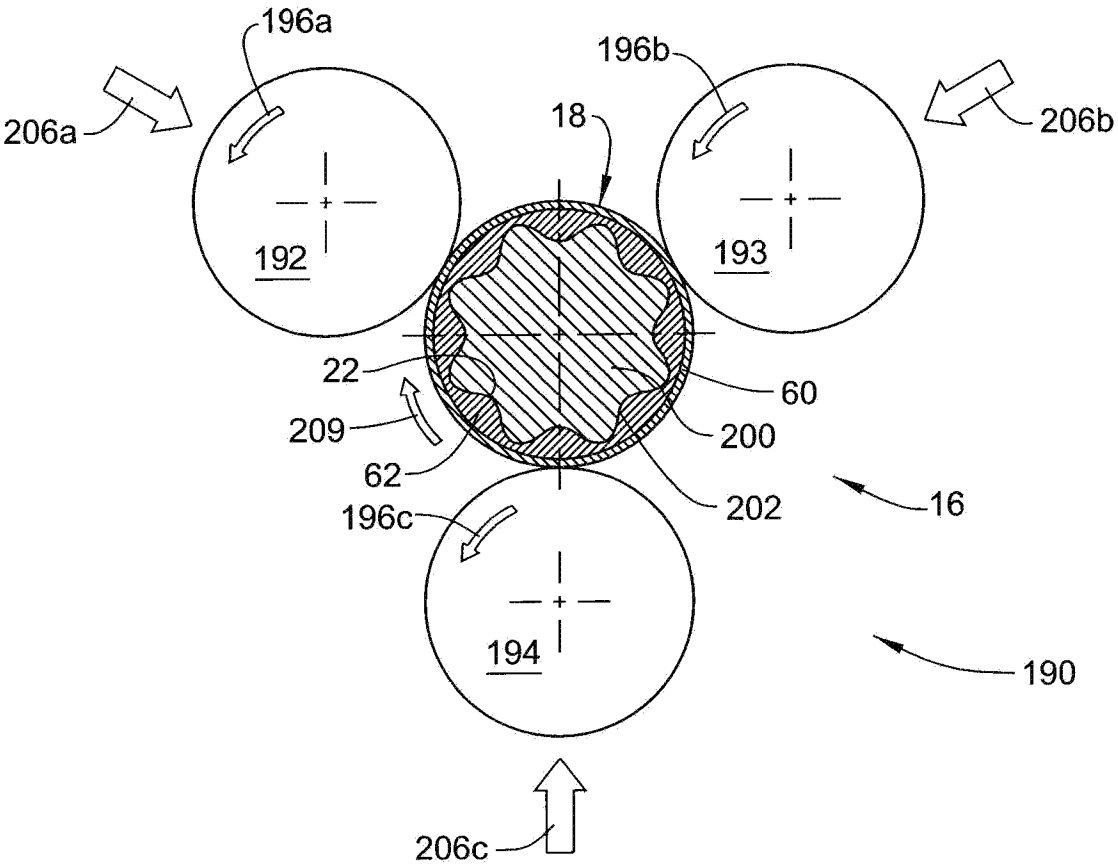
FIG. 5 depicts an elevational view of a rotary system for making the composite metal housing, in accordance with yet another aspect of an exemplary embodiment.

Reference will now follow to FIG. 5, wherein like reference numbers represent corresponding parts in the respective views in describing a rolling process 190 employing a first force application member shown as a first roller 192, a second force application member shown as a second roller 193, and a third force application member shown as a third roller 194 which rotate about a corresponding central axis (not separately labeled) in a direction identified by arrows 196*a*-196*c*. A rigid mandrel 200 having a contoured outer surface 202 is arranged in interior (not separately labeled) of inner tubular member 62. In operation, rollers 192-194 rotate and are urged radially inwardly in a direction identified by arrows 206*a*-206*c* applying a compressive force to outer tubular member 60 and inner tubular member 62. At the same time, outer and inner tubulars members 60 and 62 rotate in a direction identified by arrow 209 opposite first, second, and third rollers 192, 193, and 194. As the process continues, inner tubular member 62 takes on a shape corresponding to contoured outer surface 202 of rigid mandrel 200 forming helically lobed inner surface 22. In addition to forming helically lobed inner surface 22, compressive forces applied by rollers 192-194 compress outer tubular member 60 onto inner tubular member 62.

Figure 6:
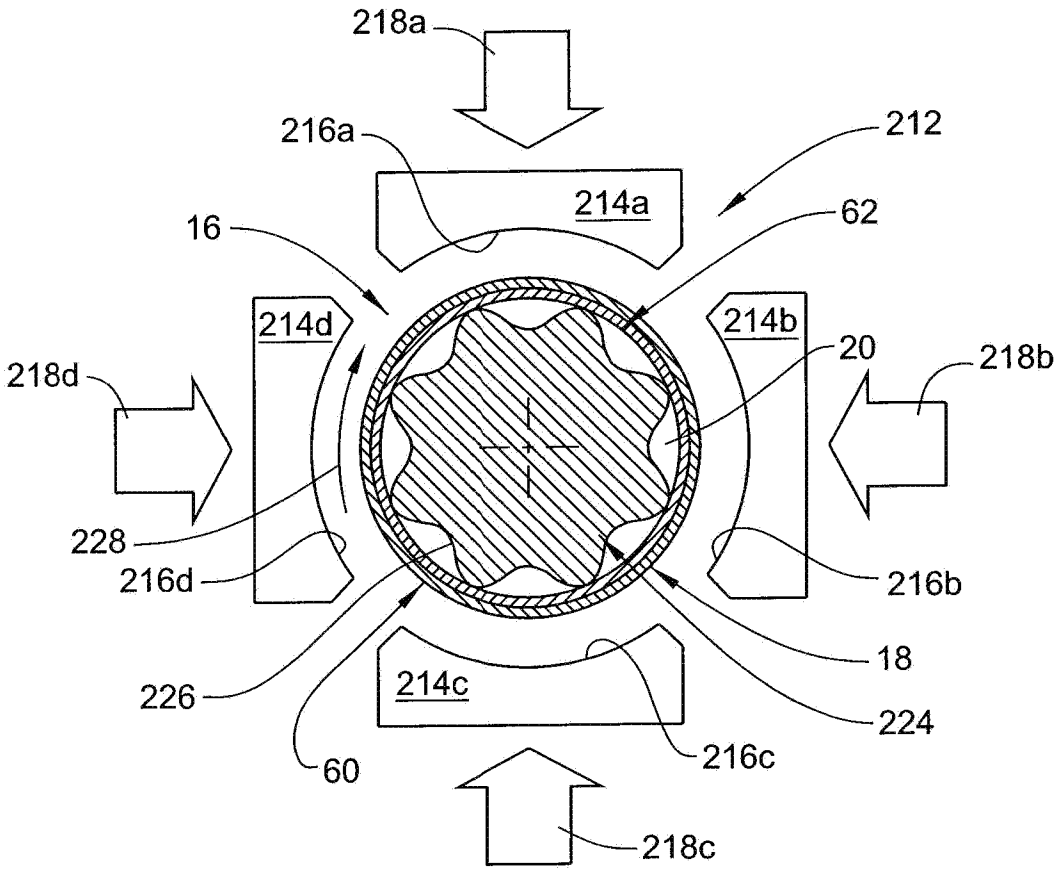
FIG. 6 depicts a swaging process for making the composite metal housing, in accordance with still yet another aspect of an exemplary embodiment.

Reference will now follow to FIG. 6 wherein like reference numbers represent corresponding parts in the respective views in describing a rotary swaging process 212. Rotary swaging process 212 employs a plurality of force application members shown in the form of swaging devices or conforming blocks 214*a*, 214*b*, 214*c*, and 214*d* arranged about outer tubular member 60 and inner tubular member 62. Each conforming block 214*a*-214*d* includes a corresponding concave inner surface 216*a*-216*d*. Conforming blocks 214*a*-214*d* are urged radially inwardly in a direction identified by corresponding arrows 218*a*-218*d* applying a compressive force to outer tubular member 60 and inner tubular member 62. A rigid mandrel 224 having a contoured outer surface 226 is arranged within interior 20 of inner tubular member 62.

In operation, conforming blocks 214*a*-214*d* are urged radially inwardly. At the same time, outer and inner tubulars 60 and 62 of composite metal housing 16 rotate in a direction identified by arrow 228. As the process continues, inner tubular member 62 takes on a shape corresponding to contoured outer surface 226 of rigid mandrel 224 forming helically lobed inner surface 22 such as shown in FIG. 2. In addition to forming helically lobed inner surface 22, compressive forces applied by conforming blocks 214*a*-214*d* force outer tubular member 60 onto inner tubular member 62 forming a connection.

Figure 7:
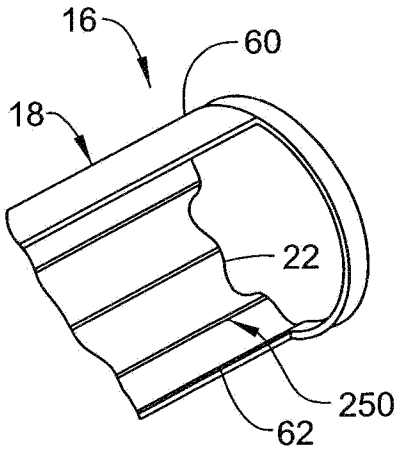
FIG. 7 depicts a partial cut-away view of a metal housing formed in accordance with an aspect of an exemplary embodiment.

Once composite metal housing 16 of stator 18 (FIG. 1A) is formed, one or more channels, one of which is indicated at 250 in FIG. 7 may be formed in helically lobed inner surface 22. Channels 250 may promote cooling of downhole motor 10. Additionally, it is understood that composite metal housing 16 forming stator 18 may include one or more channels and/or passages that may serve as conduits for electrical cabling, hydraulic lines, and the like. Channels 250 may be achieved by placing a third material which could take the form of a massive material (not shown) in between outer tubular member 60 and inner tubular member 62 prior to forming helically lobed inner surface 22. The massive material may later be dissolved by one of a variety of known processes such as by heating, etching, applying a chemical, a subtractive a machining method or the like such as shown in FIG. 7. By non-limiting example the massive material may take the form of a round bar member, a non-round bar member, a folded bar member and/or a non-folded bar member.

It is also to be understood that composite metal housing 16 forming stator 18 may be formed by any of the above described methods and/or other suitable processes. The use of different materials to form composite metal housing 16 provides better strength characteristics as well as enhances wear and corrosion resistance. For example, outer tubular member 60 may be formed from a first material having desired strength characteristics while inner tubular member 62 may be formed from a second material suitable for a selected forming operation. The second material may also be selected for desired finishing characteristics including hard facing, corrosion protection without compromising other desired properties such as strength and formability.

It should be understood that additional layers (not shown) may exist between outer tubular member 60 and inner tubular member 62 that promote connecting inner and outer tubulars and/or provide a desired heat barrier, electrical insulating layer, material diffusion layer, or the like. Such an intermediate layer may cover all or a portion of the inner surface of outer tubular member 60. Further, it is to be understood that outer tubular member 60 may be pre-contoured.

Although, the method described herein is employed to form a stator of a progressive cavity motor, the method may also be employed to form other stators, such as a stator for a progressive cavity pump following the Moineau principle.

Embodiment 1

A method of making a stator comprising: positioning an inner tubular member having an inner surface within an outer tubular member; installing a rigid mandrel within the inner tubular member; and applying a compressive force to at least one of the inner tubular member and the outer tubular member.

Embodiment 2

The method of embodiment 1, wherein positioning the inner tubular member within the outer tubular member includes positioning an inner tubular member formed from a first material in an outer tubular member formed from a second material that is distinct from the first material.

Embodiment 3

The method of embodiment 2, wherein the first material is more pliable than the second material.

Embodiment 4

The method of embodiment 2, further comprising: positioning a third material between the inner tubular member and the outer tubular member; and forming, with the third material, one or more channels between the inner tubular member and the outer tubular member.

Embodiment 5

The method of embodiment 4, wherein forming, with the third material, the one or more channels includes at least one of heating the third material, etching the third material, and electrochemically machining the third material.

Embodiment 6

The method of embodiment 4, wherein positioning the third material includes introducing one of a round bar member, a non-round bar member, and a folded bar member and a non-folded bar member formed from the third material between the inner tubular member and the outer tubular member.

Embodiment 7

The method of embodiment 1, wherein installing the rigid mandrel includes installing a member having a selected contour within the inner tubular member.

Embodiment 8

The method of embodiment 7, wherein applying the compressive force includes forming the selected contour on the inner surface of the inner tubular member.

Embodiment 9

The method of embodiment 8, wherein forming the selected contour includes forming at least one lobe on the inner surface of the inner tubular member.

Embodiment 10

The method of embodiment 8, further comprising: positioning an inner layer on the selected contour formed on the inner surface of the inner tubular member.

Embodiment 11

The method of embodiment 10, wherein positioning the inner layer includes bonding the inner layer to the selected contour.

Embodiment 12

The method of embodiment 11, wherein bonding the inner layer to the selected contour includes bonding an elastomeric material to the selected contour.

Embodiment 13

The method of embodiment 1, wherein applying the compressive force includes compressing the outer tubular member between at least two rollers.

Embodiment 14

The method of embodiment 13, wherein compressing the outer tubular member between at least two rollers includes shifting the rollers along the outer tubular member.

Embodiment 15

The method of embodiment 14, wherein applying the compressive force through the at least two rollers includes rotating the outer tubular member and the inner tubular member.

Embodiment 16

A Moineau system configured for use in a downhole environment comprising: an inner tubular member comprising a first metallic material having an outer surface and a helically lobed inner surface integrally formed with the inner tubular member; and an outer tubular member comprising a second metallic material that is different from the first metallic material, wherein the inner tubular member is connected to the outer tubular member by a form fit, the inner tubular member and the outer tubular member forming a stator of the Moineau system.

Embodiment 17

The Moineau system according to embodiment 16, wherein the first metallic material is more pliable than the second metallic material.

Embodiment 18

The Moineau system according to embodiment 16, further comprising: one or more channels extending between the inner tubular member and the outer tubular member.

Embodiment 19

The Moineau system according to embodiment 16, further comprising: an inner layer provided on the helically lobed inner surface.

Embodiment 20

The Moineau system according to embodiment 19, wherein the inner layer comprises an elastomeric material.

The term "about" is intended to include the degree of error associated with measurement of the particular quantity based upon the equipment available at the time of filing the application. For example, "about" can include a range of ±8% or 5%, or 2% of a given value.

While one or more embodiments have been shown and described, modifications and substitutions may be made thereto without departing from the spirit and scope of the invention. Accordingly, it is to be understood that the present invention has been described by way of illustrations and not limitation.

The invention claimed is:

1. A method of making a stator comprising:

positioning an inner tubular member having an inner surface within an outer tubular member, both the inner tubular member and the outer tubular member being formed from metal;

installing a rigid mandrel within the inner tubular member; and applying a compressive force to the inner tubular member and the outer tubular member, the compressive force causing the inner tubular member to be connected to the outer tubular member.

2. The method of claim 1, wherein positioning the inner tubular member within the outer tubular member includes positioning an inner tubular member formed from a first material in an outer tubular member formed from a second material that is distinct from the first material.

3. The method of claim 2, wherein the first material is more pliable than the second material.

4. The method of claim 2, further comprising:

positioning a third material between the inner tubular member and the outer tubular member; and forming, with the third material, one or more channels between the inner tubular member and the outer tubular member.

5. The method of claim 4, wherein forming, with the third material, the one or more channels includes at least one of heating the third material, etching the third material, and electrochemically machining the third material.

6. The method of claim 4, wherein positioning the third material includes introducing one of a round bar member, a non-round bar member, and a folded bar member and a non-folded bar member formed from the third material between the inner tubular member and the outer tubular member.

7. The method of claim 1, wherein installing the rigid mandrel includes installing a member having a selected contour within the inner tubular member.

8. The method of claim 7, wherein applying the compressive force includes imparting the selected contour on to the inner surface of the inner tubular member such that the inner surface takes on the selected contour.

9. The method of claim 8, wherein imparting the selected contour includes the inner surface of the inner tubular member taking on at least one lobe.

10. The method of claim 8, further comprising: positioning an inner layer on the selected contour taken on by the inner surface of the inner tubular member.

11. The method of claim 10, wherein positioning the inner layer includes bonding the inner layer to the selected contour taken on by the inner surface of the inner tubular member.

12. The method of claim 11, wherein bonding the inner layer to the selected contour taken on by the inner surface of the inner tubular member includes bonding an elastomeric material to the selected contour.

13. The method of claim 1, wherein applying the compressive force includes compressing the outer tubular member between at least two rollers.

14. The method of claim 13, wherein compressing the outer tubular member between at least two rollers includes shifting the rollers along the outer tubular member.

15. The method of claim 14, wherein applying the compressive force through the at least two rollers includes rotating the outer tubular member and the inner tubular member.

* * * * *